US006624720B1

(12) United States Patent
Allison et al.

(10) Patent No.: US 6,624,720 B1
(45) Date of Patent: Sep. 23, 2003

(54) MICRO ELECTRO-MECHANICAL SYSTEM (MEMS) TRANSFER SWITCH FOR WIDEBAND DEVICE

(75) Inventors: Robert C. Allison, Rancho Palos Verdes, CA (US); Jar J. Lee, Irvine, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/219,889

(22) Filed: Aug. 15, 2002

(51) Int. Cl.[7] ..... H01P 1/10; H01P 5/12; H01Q 3/26

(52) U.S. Cl. ..... 333/105; 342/373; 342/374

(58) Field of Search ..... 333/101, 105, 333/262; 342/373, 374

(56) References Cited

U.S. PATENT DOCUMENTS

| | | | | |
|---|---|---|---|---|
| 5,578,976 A | | 11/1996 | Yao | |
| 5,757,319 A | * | 5/1998 | Loo et al. | 333/262 |
| 5,874,915 A | | 2/1999 | Lee et al. | |
| 6,046,659 A | | 4/2000 | Loo et al. | |
| 6,331,257 B1 | | 12/2001 | Loo et al. | |
| 6,440,767 B1 | * | 8/2002 | Loo et al. | 333/262 |
| 2003/0027361 A1 | * | 2/2003 | Lempkowski | 438/3 |

FOREIGN PATENT DOCUMENTS

| | | | | |
|---|---|---|---|---|
| EP | 0 840 394 A2 | * | 6/1998 | H01Q/3/26 |
| JP | 10 260245 A | * | 9/1998 | H01Q/3/26 |

OTHER PUBLICATIONS

MEMS and Si–micromachined components for low–power, high–frequency communications systems, L.P.B. Katehi, 1998 IEEE MTT–S International Microwave Symposium Digest, vol. 1, p. 331–333, Jun. 1998.*

MEMS and Si micromachined circuits for high–frequency applications, L.P.B. Katehi, IEEE Transactions on Microwave Theory and Techniques, vol. 50(3), p. 858–866, Mar. 2002.*

* cited by examiner

*Primary Examiner*—Thomas H. Tarcza
*Assistant Examiner*—Fred H Mull
(74) *Attorney, Agent, or Firm*—Leonard A. Alkov; Glenn H. Lenzen, Jr.

(57) ABSTRACT

A micro electromechanical system (MEMS) transfer switch for simultaneously connecting two radio frequency (RF) input transmission lines among two RF output transmission lines. The MEMS transfer switch includes a plurality of series MEMS switching units operatively arranged with the input and output transmission lines to selectively connect a first input to a first output and a second input to a second output, or the second input to the first output and the first input to the second output.

21 Claims, 4 Drawing Sheets

MICRO ELECTRO-MECHANICAL SYSTEM (MEMS) TRANSFER SWITCH FOR WIDEBAND DEVICE

TECHNICAL FIELD

The present invention generally relates to switches used in conjunction with antennas and, more particularly, to a MEMS transfer switch for use in coupling a radio frequency (RF) signal to an antenna or an RF signal received by an antenna to an associated circuit.

BACKGROUND

A wide variety of antennas are used to transmit and/or receive signals at microwave or millimeterwave frequencies. These signals (commonly referred to as radio frequency (RF) signals) often pass through switches between a transceiver circuit and the antenna. In some applications, a transfer switch is used to simultaneously route two input signals among two outputs of the switch (e.g., a double pole, double throw switch).

As an example, U.S. Pat. No. 5,874,915, the disclosure of which is herein incorporated by reference in its entirety, discloses a wideband electronically scanned cylindrical UHF antenna array and associated beamforming network that uses a matrix of electronically controlled transfer switches. The electronically scanned array (ESA) disclosed in the '915 patent can be used, for example, as part of an airborne early warning (AEW) radar. In the past, such transfer switches have been implemented with PIN diodes, gallium arsenide (GaAs) field effect transistors (FETs), latching circulators and electromechanical devices such as relays.

Conventional transfer switches formed with PIN diodes, FETs, latching circulators and relays have been known to introduce undesirable amounts of insertion loss, especially for relative high RF bands. In addition, latching circulators have a relatively narrow bandwidth, slow switching speeds, and require a current driver. Latching circulators tend also to be large and heavy making their use in some airborne applications impractical. Furthermore, relays have a relatively slow switching speed that can be too slow for scanning applications.

Another drawback of conventional transfer switches is that splits or "tees" in the input and output transmission lines are used to connect the transmission lines to the switches. When a switch is placed in an open position, the tee acts as a capacitive stub that can result in an impedance mismatch in the signal path. As a result, the tee limits the bandwidth of the device.

Accordingly, there exists a need in the art for higher performance transfer switches for use in RF applications.

SUMMARY OF THE INVENTION

According to one aspect of the invention, the invention is directed to a micro electro-mechanical system (MEMS) transfer switch. The MEMS transfer switch includes a first and a second radio frequency (RF) input transmission line; a first and a second RF output transmission line; and a plurality of series MEMS switching units operatively arranged with the input and output transmission lines to selectively connect either the first input transmission line to the first output transmission line and the second input transmission line to the second output transmission line or the second input transmission line to the first output transmission line and the first input transmission line to the second output transmission line.

According to another aspect of the invention, the invention is directed to a micro electro-mechanical system (MEMS) transfer switch for simultaneously connecting two radio frequency (RF) input transmission lines among two RF output transmission lines. The MEMS transfer switch includes a first MEMS switching unit positioned to electrically couple a contact engagement end of a first of the input transmission lines and a contact engagement end a first of the output transmission lines when the first switching unit is placed in a closed position; a second MEMS switching unit positioned to electrically couple a contact engagement end of a second of the input transmission lines and a contact engagement end a second of the output transmission lines when the second switching unit is placed in a closed position; a third MEMS switching unit positioned to electrically couple the contact engagement end of the first of the input transmission lines and the contact engagement end the second of the output transmission lines when the third switching unit is placed in a closed position; and a forth MEMS switching unit positioned to electrically couple the contact engagement end of the second of the input transmission lines and the contact engagement end the first of the output transmission lines when the fourth switching unit is placed in a closed position.

BRIEF DESCRIPTION OF DRAWINGS

These and further features of the present invention will be apparent with reference to the following description and drawings, wherein.

DISCLOSURE OF INVENTION

Figure 1:
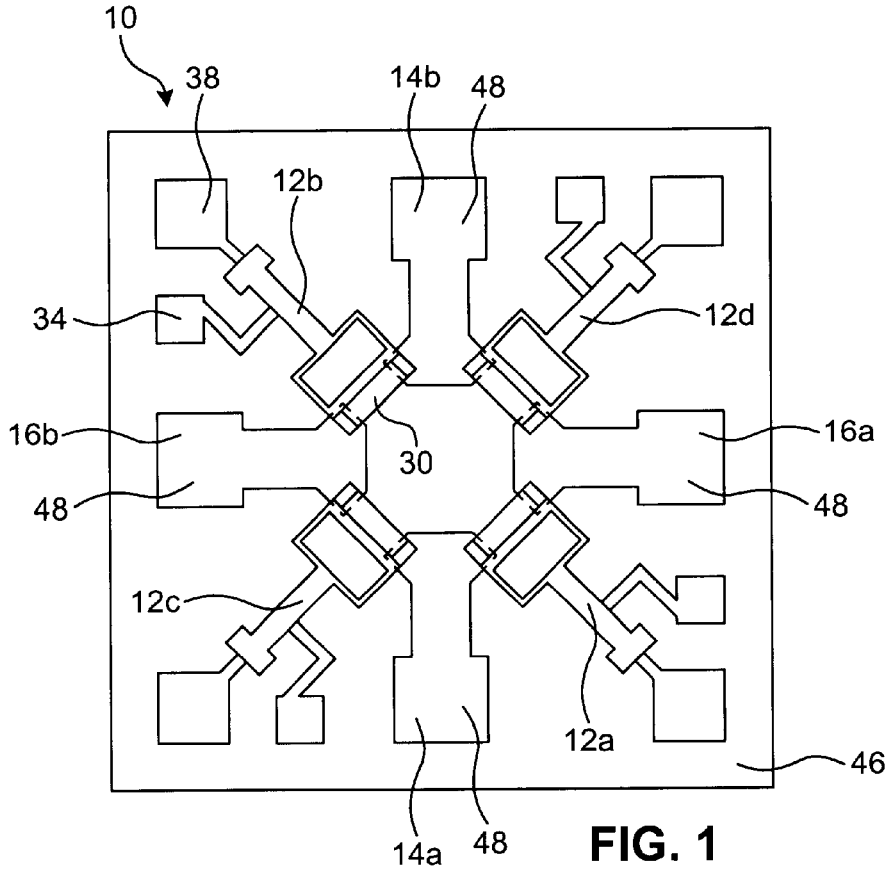
FIG. 1 is a block diagram of a micro electro-mechanical system (MEMS) transfer switch according to the present invention.

In the detailed description that follows, similar components have been given the same reference numerals, regardless of whether they are shown in different embodiments of the present invention. To illustrate the present invention in a clear and concise manner, the drawings may not necessarily be to scale and certain features may be shown in somewhat schematic form.

Referring initially to FIG. 1, shown is a block diagram of a wideband micro electro-mechanical system (MEMS) transfer switch 10. In the illustrated embodiment, the MEMS transfer switch 10 includes four MEMS switching elements (referred to herein as switching units 12) that are used to selectively couple each of two input transmission lines 14 to two output transmission lines 16. Although the MEMS transfer switch 10 described herein can have a number of uses and can be used in a number of different types of systems, the MEMS transfer switch 10 is particularly well suited for use in coupling RF signals to an RF antenna (e.g., coupling an antenna to a transceiver circuit). Accordingly, the present invention will be described in the context of a system that uses the MEMS transfer switch 10 to simultaneously route two microwave or millimeter wave signals from a transceiver circuit, or signal source (e.g., radar signal source), to an antenna or from an antenna to a transceiver circuit, or signal destination.

As described in greater detail below, each of the switching units 12 can be placed in one of an open position or a closed position. When a first of the switching units 12*a* is placed in a closed position, the first switching unit 12*a* electrically couples a first of the input transmission lines 14*a* to a first of the output transmission lines 16*a*. When a second of the switching units 12*b* is placed in a closed position, the second switching unit 12*b* electrically couples a second of the input transmission lines 14*b* to a second of the output transmission lines 16*b*. When a third of the switching units 12*c* is placed in a closed position, the third switching unit 12*c* electrically couples the first input transmission line 14*a* to the second output transmission line 16*b*. When a fourth of the switching units 12*d* is placed in a closed position, the fourth switching unit 12*d* electrically couples the second input transmission line 14*b* to the first output transmission line 16*a*.

Figure 3A:
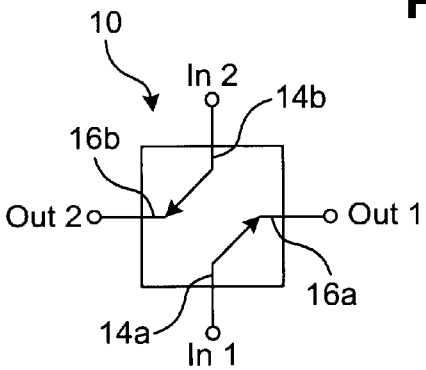
FIG. 3A is an electrical schematic of the MEMS transfer switch of FIG. 1 in a first switching configuration.

With additional reference to FIG. 3A, the MEMS transfer switch 10 is schematically represented when the MEMS transfer switch 10 is placed in a first switching configuration. More specifically, in the first switching configuration, the first and second switching units 12*a*, 12*b* are closed such that the first input transmission line 14*a* and the first output transmission line 16*a* are electrically coupled to one another via the first switching unit 12*a* and the second input transmission line 14*b* and the second output transmission line 16*b* are electrically coupled to one another via the second switching unit 12*b*. In the first switching configuration, the third and fourth switching units 12*c*, 12*d* are placed in the open position.

Figure 3B:
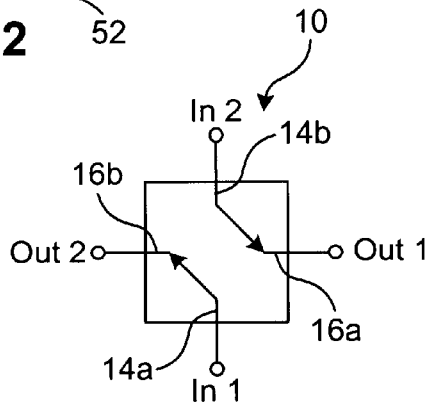
FIG. 3B is an electrical schematic of the MEMS transfer switch of FIG. 1 in a second switching configuration.

With additional reference to FIG. 3B, the MEMS transfer switch 10 is schematically represented when the MEMS transfer switch 10 is placed in a second switching configuration. More specifically, in the second switching configuration, the third and fourth switching units 12*c*, 12*d* are closed such that the first input transmission line 14*a* and the second output transmission line 16*b* are electrically coupled to one another via the third switching unit 12*c* and the second input transmission line 14*b* and the first output transmission line 16*a* are electrically coupled to one another via the fourth switching unit 12*d*. In the second switching configuration, the first and second switching units 12*a*, 12*b* are placed in the open position.

Figure 4:
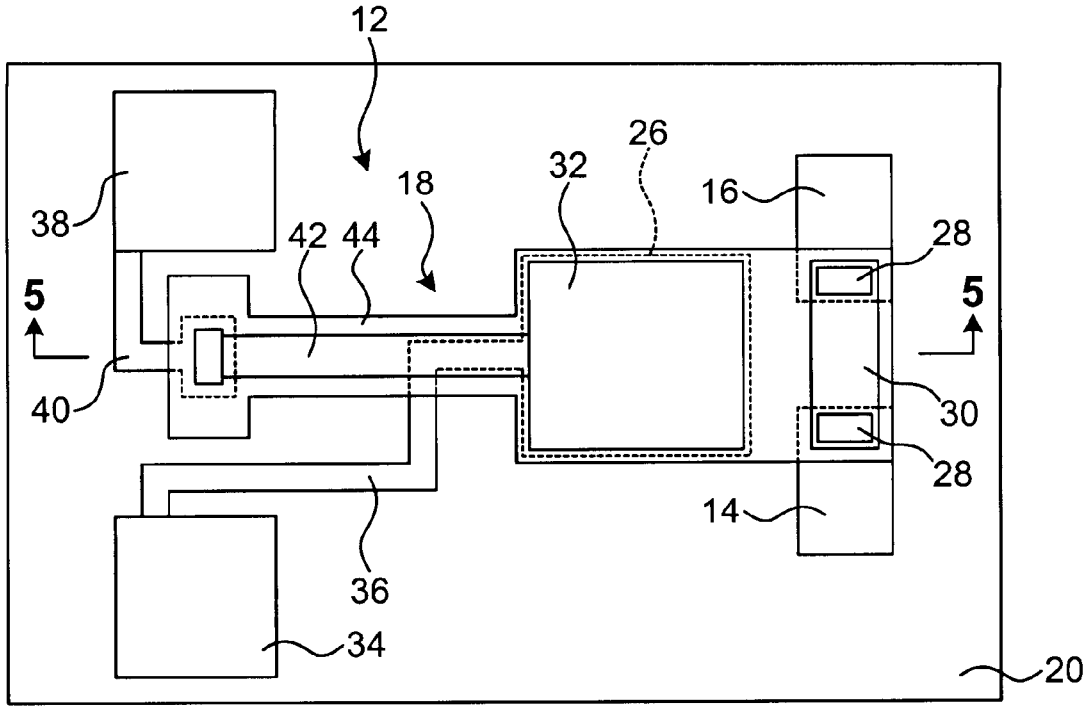
FIG. 4 is a block diagram of an exemplary switching unit for use as part of the MEMS transfer switch of FIG. 1.

With additional reference to FIG. 4, a block diagram of an individual switching unit 12 that could be used as any of the component switching units 12*a*, 12*b*, 12*c* and 12*d* for the MEMS transfer switch 10 is illustrated. Each switching unit 12 can be viewed as a single pole, single throw (SPST) switch device. More particularly, each switching unit 12 can be implemented with a MEMS series switch that interrupts signal transmission by opening a conduction path between an input transmission line 14 and an output transmission line 16.

Figure 5A:
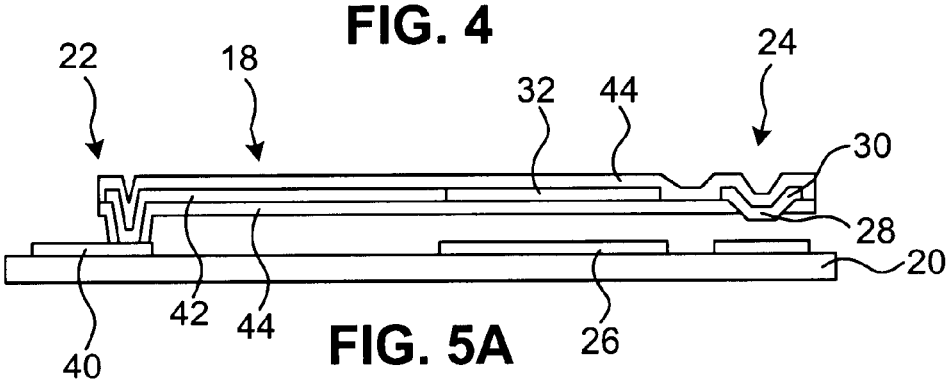
FIG. 5A is a cross section of the switching unit of FIG. 4 in an open position and taken along the line 5—5.
Figure 5B:
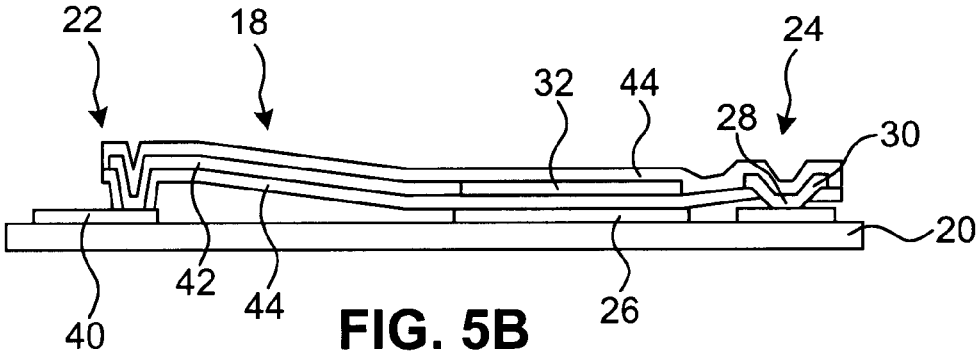
FIG. 5B is a cross section of the switching unit of FIG. 4 in a closed position and taken along the line 5—5.

Also referring to FIG. 5A (illustrating a cross-section of the switching unit 12 in an open position) and FIG. 5B (illustrating a cross-section of the switching unit 12 in a closed position), features and characteristics of the switching unit 12 will be described below. Briefly, the switching unit 12 is a metal-to-metal contact series switch that exhibits relatively low insertion loss and high isolation through microwave and millimeter wave frequencies. Additional details of a suitable switching unit can be found in U.S. Pat. No. 6,046,659, the disclosure of which is herein incorporated by reference in its entirety.

The switching unit 12 includes an armature 18 affixed to a substrate 20 at a proximal end 22 of the armature 18. A distal end (or contact end 24) of the armature 18 is positioned over an input transmission line 14 and an output transmission line 16. A substrate bias electrode 26 can be disposed on the substrate 20 under the armature 18 and, when the armature 16 is in the open position, the armature 16 is spaced from the substrate bias electrode 26 and the lines 14 and 16 by an air gap.

A pair of conducting dimples, or contacts 28, protrude downward from the contact end 24 of the armature 18 such that in the closed position, one contact 28 contacts the input line 14 and the other contact 28 contacts the output line 16. The contacts 28 are electrically connected by a conducting transmission line 30 so that when the armature 18 is in the closed position, the input line 14 and the output line 16 are electrically coupled to one another by a conduction path via the contacts 28 and conducting line 30. Signals can then pass from the input line 14 to the output line 16 (or vice versa) via the switching unit 12. When the armature 18 is in the open position, the input line 14 and the output line 16 are electrically isolated from one another.

Above the substrate bias electrode 26, the armature 18 is provided with a armature bias electrode 32. The substrate bias electrode 26 is electrically coupled to a substrate bias pad 34 via a conductive line 36. The armature bias electrode 32 is electrically coupled to an armature bias pad 38 via a conductive line 40 and armature conductor 42. When a suitable voltage potential is applied between the substrate bias pad 34 and the armature bias pad 38, the armature bias electrode 32 is attracted to the substrate bias electrode 26 to actuate the switching unit 12 from the open position (FIG. 5A) to the closed position (FIG. 5B).

The armature 18 can include structural members 44 for supporting components such as the contacts 28, conducting line 30, bias electrode 32 and conductor 42. It is noted that the contacts 28 and conductor 30 can be formed from the same layer of material or from different material layers. In the illustrated embodiment, the armature bias electrode 32 is nested between structural member 44 layers.

Referring back now to FIG. 1, the physical arrangement of the illustrated example of the MEMS transfer switch 10 will be described in greater detail. In the illustrated embodiment, the MEMS transfer switch 10 is a monolithic circuit that includes four series SPST MEMS switching units 12 to form a double pole, double throw (DPDT) switch configuration. Briefly, the switching units 12 are oriented such that the contacts 28 are located over corresponding contact engagement areas of the input and output transmission lines 14 and 16 in a manner to minimize or completely avoid the creation of a split or tee in the input and output transmission lines 14 and 16. In the MEMS transfer switch 10, the input and output transmission lines 14 and 16 are arranged directly in the electrical connection path of the switching units 12. As a result, the creation of capacitive stubs that could otherwise result in impedance mismatches is minimized. As will be described in greater detail below, small parasitic impedance mismatches created by the switching units 12 can be compensated by impedance matching formed in the input transmission line 14 and/or the output transmission line 16. The resulting MEMS transfer switch 10 exhibits enhanced broadband performance characteristics over prior art transfer switches.

The switching units 12 are disposed on a substrate 46. The switching units 12 are arranged such that a longitudinal axis of each switching unit 12 is perpendicular to each adjacent switching unit 12 and such that the conducting line 30 of each switching unit 12 is disposed towards a center of the MEMS transfer switch 10. The first switching unit 12*a* and the second switching unit 12*b* are located opposite one another such that the longitudinal axis of the first switching unit 12*a* and the longitudinal axis of the second switching unit 12*b* coincide. The third switching unit 12*c* and the fourth switching unit 12*d* are located opposite one another such that the longitudinal axis of the third switching unit 12*c* and the longitudinal axis of the fourth switching unit 12*d* coincide, but are perpendicular to the longitudinal axis of the first and second switching units 12*a* and 12*b*. As a result, the contact end 24 of each switching unit 12 is disposed towards a center of the MEMS transfer switch 10 and each switching unit 12 extends radially outward at generally evenly spaced intervals (in the illustrated embodiment, the intervals are about ninety degrees).

The substrate bias pad 34 and the armature bias pad 38 for each switching unit 12 are located toward a periphery of the MEMS transfer switch 10 to allow for electrical connection to the bias pads 34 and 38 from a control circuit (not shown). Connection to the bias pads 34 and 38 can be made using, for example, vias, filled contact holes, conductor runs, wire bonds and so forth. In one embodiment, the armature bias pads 38 are grounded and each substrate bias pad 34 is coupled to receive an actuation input signal that controls the corresponding switching unit 12 to be in the open or the closed position. Since the switching units 12 can be switched in pairs (the first and second switching units 12*a* and 12*b* are simultaneously closed to achieve the first switching configuration of FIG. 3A and the third and fourth switching units 12*c* and 12*d* are simultaneously closed to achieve the second switching configuration of FIG. 3B), the first and second switching units 12*a* and 12*b* can be connected to receive a first actuation input signal and the third and fourth switching units 12*c* and 12*d* can be connected to receive a second input actuation signal.

Disposed between each adjacent switching unit 12 can be a transmission line 48. Two of the transmission lines 48 can be used as the input transmission lines 14*a* and 14*b* and another two of the transmission lines 48 can be used as the output transmission lines 16*a* and 16*b*. Similar to the switching units 12, the transmission lines 48 are disposed on the substrate 46 and such that a longitudinal axis of each transmission line 48 is perpendicular to each adjacent transmission line 48. Accordingly, the longitudinal axis of each transmission line 48 is disposed at a forty-five degree angle from each adjacent switching unit 12.

Figure 2:
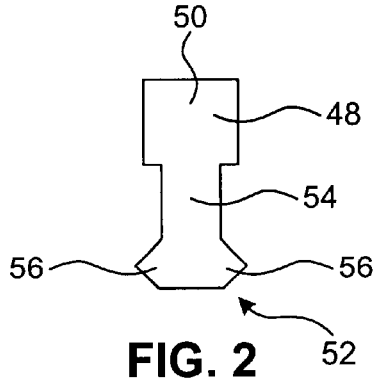
FIG. 2 is a block diagram of an exemplary input/output line from the MEMS transfer switch of FIG. 1.

With additional reference to FIG. 2, one of the transmission lines 48 is illustrated in greater detail. Each transmission line 48 can include a pad portion 50 and a switching unit contact engagement end 52. The contact engagement end 52 and the pad portion 50 can be electrically coupled to each other by an impedance matched section 54.

The engagement end 52 of each transmission line 48 is disposed towards a center of the MEMS transfer switch 10 and the longitudinal axis of the first input transmission line 14*a* and the longitudinal axis of the second input transmission line 14*b* coincide. In this embodiment, the longitudinal axis of the first output transmission line 16*a* and the longitudinal axis of the second output transmission line 16*b* also coincide, but are perpendicular to the longitudinal axis of the first and second input transmission lines 14*a* and 14*b*. As a result, the engagement end 52 of each transmission line 48 is disposed towards a center of the MEMS transfer switch 10 and each transmission line 48 extends radially outward at generally evenly spaced intervals (in the illustrated embodiment, the intervals are about ninety degrees).

The engagement end 52 of each transmission line 48 includes a pair of switching unit contact engagement surfaces 56. The engagement surfaces 56 are positioned below the contacts 28 of each adjacent switching unit 12 such that when the switching unit 12 is closed, the contact 28 of the closed switching unit 12 will establish electrical connection to the transmission line 48. In this arrangement, two adjacent switching units 12 have a common junction defined by the engagement end 52 of the transmission line 48 disposed between the adjacent switching units 12. In the illustrated embodiment, the engagement surfaces 56 are formed from generally triangular shaped portions of the transmission lines 48 that extend laterally outward from the transmission line 48. In this embodiment, the engagement end 52 is wider than the impedance matched section 54 and is optionally wider than the pad portion 50. As one skilled in the art will appreciate, the engagement surfaces 56 can be formed to have alternative geometric configurations.

In the illustrated embodiment, when any of the switching units 12 is placed in the closed position, one of the contacts 28 will engage the engagement surface 52 of the input transmission line 14 that is disposed under the contact 28 and the other contact will engage the engagement surface of the output transmission line 16 that is disposed under the other of the contacts 28. As a result, electrical connection between the corresponding input transmission line 14 and the corresponding output transmission line 16 can be established.

The pad portion 50 of each transmission line 48 is located toward a periphery of the MEMS transfer switch 10 to allow for electrical connection to the pad portion 50 from an RF signal source (not shown) in the case of an input transmission line 14 and from an RF signal destination (not shown) in the case of an output transmission line 16. Connection to the pad portions 50 can be made using, for example, vias, conductor runs, filled contact holes, wire bonds and so forth. In one embodiment, the pad portion 50 can be part of a conductor run formed on the substrate 46. For example, the conductor run can couple an output of one MEMS transfer switch 10 to an input of another MEMS transfer switch 10.

In the illustrated embodiment, the MEMS transfer switch 10 is generally symmetric about any axis drawn through the center of the MEMS transfer switch 10. However, one skilled in the art will appreciate that the MEMS transfer switch need not be symmetrically arranged to achieve the functionality described herein with the associated performance advantages. Therefore, the MEMS transfer switch 10 can have physical features different than those illustrated and described herein.

Figure 6A:
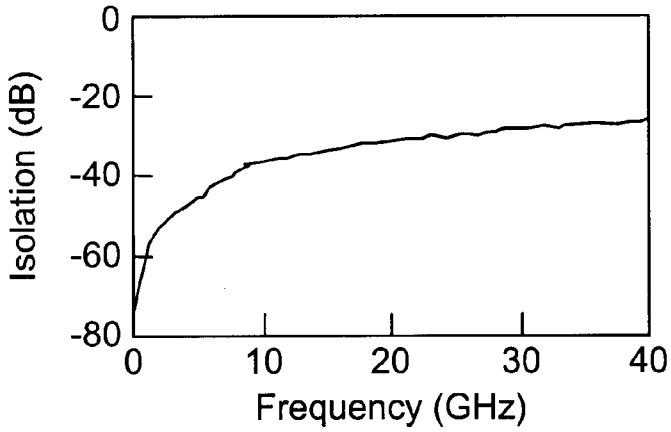
FIG. 6A is a graph of isolation versus frequency for the switching unit of FIG. 4 in the open position.
Figure 6B:
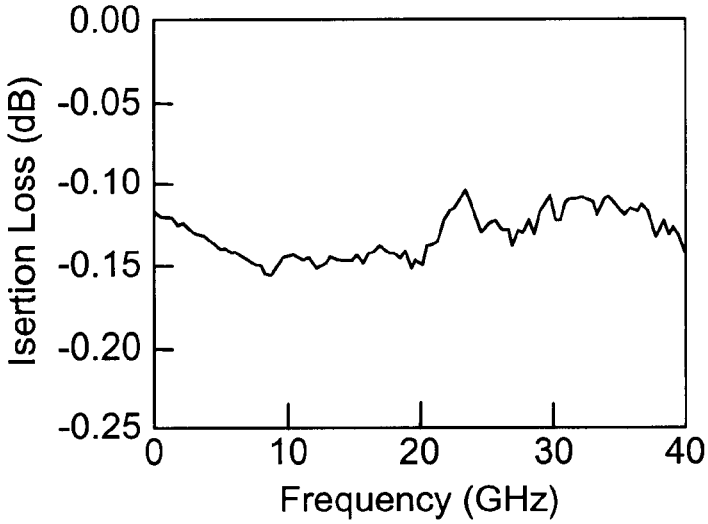
FIG. 6B is a graph of insertion loss versus frequency for the switching unit of FIG. 4 in the closed position.

As indicated above, each switching unit 12 exhibits relatively low insertion loss and high isolation through microwave and millimeter wave frequencies. FIG. 6A is a graph of isolation (expressed in dB) versus frequency (expressed in GHz) for the switching unit 12 in the open position (e.g., as illustrated in FIG. 5A). FIG. 6B is a graph of insertion loss (expressed in dB) versus frequency (expressed in GHz) for the switching unit 12 in the closed position (e.g., as illustrated in FIG. 5B). As illustrated, the insertion loss of the switching unit 12 is generally between about −0.10 dB to about −0.16 dB over the frequency range of about 0.0 GHz to about 40 GHz.

As indicated, the impedance matched section 54 (FIG. 2) can be configured to achieve desired impedance matching between the input transmission line 14 and the output transmission line 16. More specifically, the width and length of the impedance matched section 54 can be sized appropriately for the specific MEMS transfer switch 10 and/or the RF signals switched by the MEMS transfer switch 10. In one embodiment, the transmission lines are formed from a metal (e.g., gold, copper, or other conductive material) that is printed on the substrate 46 and the desired size of the impedance matched section 54 is considered during the printing process.

Figure 7:
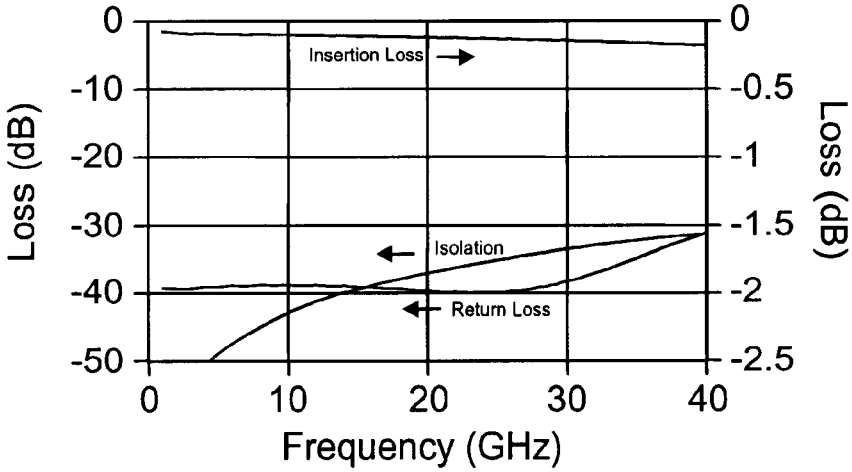
FIG. 7 is a graph of the simulated response of the MEMS transfer switch of FIG. 1 using S parameters for the switching unit of FIG. 4.

With additional reference to FIG. 7, a simulated response of the MEMS transfer switch 10 using S parameters of the switching units 12 has been illustrated. Briefly, the simulation indicates that the MEMS transfer switch 10 has an insertion loss of less than about 0.25 dB through about 40 GHz and has an isolation of greater than about 30 dB over the 0.0 GHz to about 40 GHz frequency range.

Figure 8:
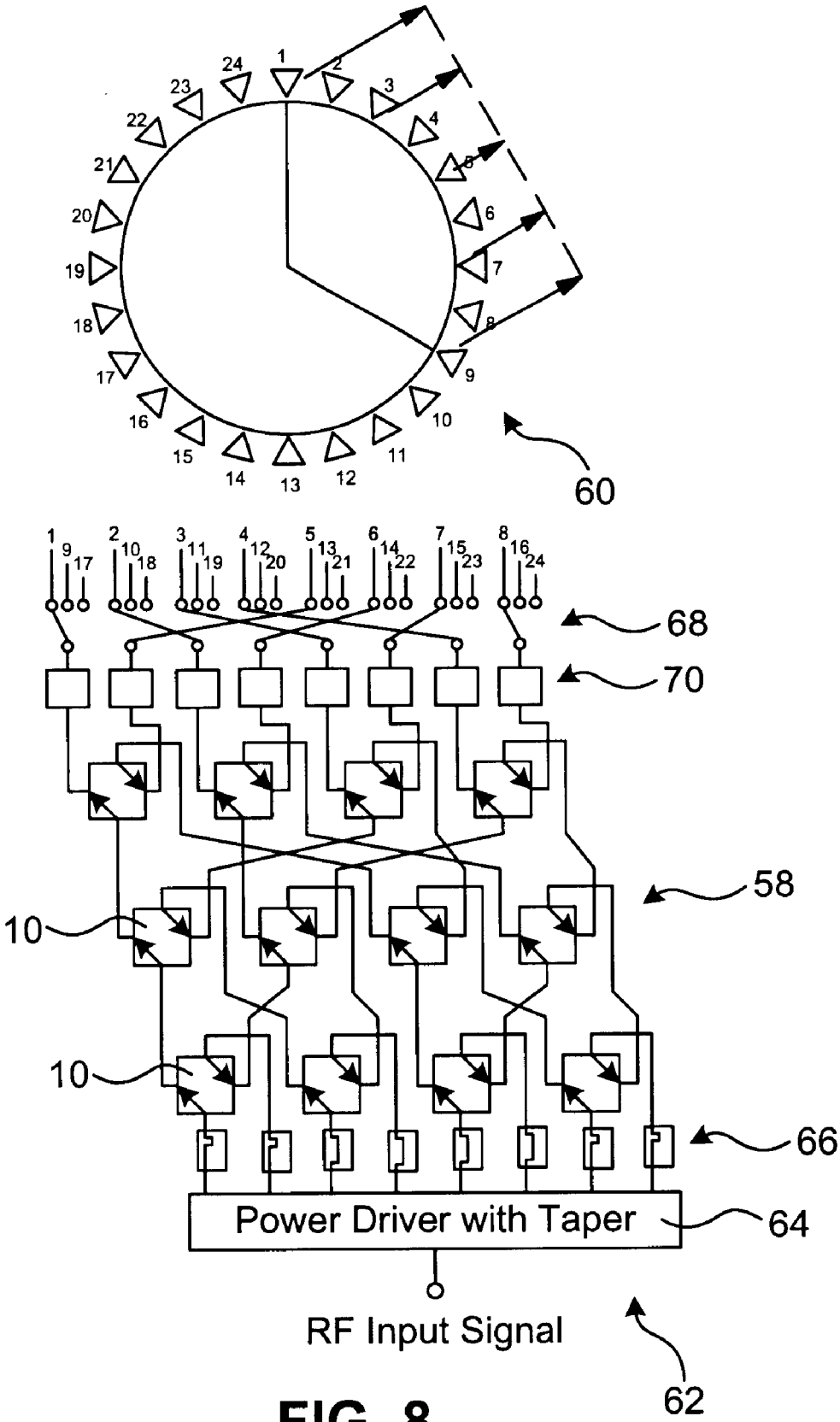
FIG. 8 is a block diagram of a wideband electronically scanned cylindrical UHF antenna array and associated beamforming network that uses a matrix of MEMS transfer switches of FIG. 1.

As indicated, the MEMS transfer switch 10 can be used in a wide variety of applications including, for example, RF systems (such as, for example, surveillance radar, point-to-multipoint communications/data links, antenna beamformer, conformal phased arrays, etc.). In one example, and as illustrated in FIG. 8, a low loss transfer switch matrix 58 comprised of MEMS transfer switches 10 can be used to switch RF input signals to a 360 degree scanning antenna array 60 (also referred to as an electronically scanned array (ESA)). One such antenna array and RF input signal network is described in greater detail in U.S. Pat. No. 5,874,915, the disclosure of which is herein incorporated by reference in its entirety.

In the exemplary antenna array 60, the RF input signals are passed through an input network 62. The input network 62 includes a power driver 64 that receives the input RF signals and has a built-in taper for the generation of relatively low sidelobes. The power driver 64 has a plurality of outputs connected to corresponding fixed delays 66.

Outputs of the delays 66 are connected to the transfer switch matrix 58. The transfer switch matrix 58 equalizes the time delay for any of the possible beam directions of the antenna array 60 by selectively connecting the fixed delays 66 to antenna array 60 columns selected by selector switches 68. The selector switches 68 selectively connect an input port associated with each output of the transfer switch matrix 58 to one of three output ports connected to columns of radiating elements of the antenna array 60 (it is noted that only twenty four antenna array 60 elements are shown for simplicity of the attached drawing, but the antenna array 60 and can include a much larger number of elements and the input network 62 can include a sized number of corresponding components for servicing the antenna array 60). Transmit/receive (T/R) modules 70, which include phase shifters for fine steering in azimuth of the antenna array 60, can be provided between outputs of the transfer switch matrix 58 and the input ports of the selector switches 68.

Although particular embodiments of the invention have been described in detail, it is understood that the invention is not limited correspondingly in scope, but includes all changes, modifications and equivalents coming within the spirit and terms of the claims appended hereto.

What is claimed is:

1. A micro electro-mechanical system (MEMS) transfer switch, comprising:

a first and a second radio frequency (RF) input transmission line;

a first and a second RF output transmission line; and a plurality of single pole single throw series MEMS switching units operatively arranged with the input and output transmission lines to selectively connect either:

the first input transmission line to the first output transmission line and the second input transmission line to the second output transmission line; or the second input transmission line to the first output transmission line and the first input transmission line to the second output transmission line.

2. The MEMS transfer switch according to claim 1, wherein:

there are four switching units and each switching unit has a contact end with a pair of electrically connected contacts;

a contact engagement end of the first input transmission line is disposed under a first contact of each of the first and third switching units;

a contact engagement end of the second input transmission line is disposed under a first contact of each of the second and fourth switching units;

a contact engagement end of the first output transmission line is disposed under a second contact of each of the first and fourth switching units; and a contact engagement end of the second output transmission line is disposed under a second contact of each of the second and third switching units.

3. The MEMS transfer switch according to claim 1, wherein at least one of the input and output transmission lines includes an impedance matched section.

4. The MEMS transfer switch according to claim 3, wherein the impedance matched section is disposed adjacent a switching unit contact engagement end of the transmission line.

5. The MEMS transfer switch according to claim 1, wherein the MEMS transfer switch has an insertion loss of less than about 0.25 dB over the frequency range of about 0.0 GHz to about 40 GHz.

6. The MEMS transfer switch according to claim 5, wherein the MEMS transfer switch has an isolation of greater than about 30 dB over the frequency range of about 0.0 GHz to about 40 GHz.

7. The MEMS transfer switch according to claim 1, wherein the MEMS transfer switch has an isolation of greater than about 30 dB over the frequency range of about 0.0 GHz to about 40 GHz.

8. In combination, a matrix of MEMS transfer switches of claim 1 and an RF antenna array having a plurality of radiating columns, wherein the matrix of MEMS transfer switches is arranged to selectively equalize a time delay of an RF input signal to a selected set of the columns.

9. A micro electro-mechanical system (MEMS) transfer switch for simultaneously connecting two radio frequency (RF) input transmission lines among two RF output transmission lines, comprising:

a first MEMS switching unit positioned to directly connect a contact engagement end of a first of the input transmission lines and a contact engagement end of a first of the output transmission lines when the first switching unit is placed in a closed position;

a second MEMS switching unit positioned to directly connect a contact engagement end of a second of the input transmission lines and a contact engagement end of a second of the output transmission lines when the second switching unit is placed in a closed position;

a third MEMS switching unit positioned to directly connect the contact engagement end of the first of the input transmission lines and the contact engagement end of the second of the output transmission lines when the third switching unit is placed in a closed position; and a fourth MEMS switching unit positioned to directly connect the contact engagement end of the second of the input transmission lines and the contact engagement end of the first of the output transmission lines when the fourth switching unit is placed in a closed position.

10. The MEMS transfer switch according to claim 9, wherein:

the first and second switching units are controlled to be either both closed or both open; and the third and fourth switching units are controlled to both be open when the first and second switching units are closed and are controlled to both be closed when the first and second switching units are open.

11. The MEMS transfer switch according to claim 9, wherein each switching unit has a contact end disposed towards a center of the MEMS transfer switch and each switching unit extends radially outward therefrom.

12. The MEMS transfer switch according to claim 11, wherein:

the contact engagement end of the first input transmission line is disposed under a first contact of each of the first and third switching units;

the contact engagement end of the second input transmission line is disposed under a first contact of each of the second and fourth switching units;

the contact engagement end of the first output transmission line is disposed under a second contact of each of the first and fourth switching units; and the contact engagement end of the second output transmission line is disposed under a second contact of each of the second and third switching units.

13. The MEMS transfer switch according to claim 9, wherein at least one of the input and output transmission lines includes an impedance matched section.

14. The MEMS transfer switch according to claim 13, wherein the impedance matched section is disposed adjacent the engagement end.

15. The MEMS transfer switch according to claim 9, wherein the MEMS transfer switch has an insertion loss of less than about 0.25 dB over the frequency range of about 0.0 GHz to about 40 GHz.

16. The MEMS transfer switch according to claim 15, wherein the MEMS transfer switch has an isolation of greater than about 30 dB over the frequency range of about 0.0 GHz to about 40 GHz.

17. The MEMS transfer switch according to claim 9, wherein the MEMS transfer switch has an isolation of greater than about 30 dB over the frequency range of about 0.0 GHz to about 40 GHz.

18. The MEMS transfer switch according to claim 9, wherein each of the switching units are series MEMS switches.

19. In combination, a matrix of MEMS transfer switches of claim 9 and an RF antenna array having a plurality of radiating columns, wherein the matrix of MEMS transfer switches is arranged to selectively equalize a time delay of an RF input signal to a selected set of the columns.

20. The MEMS transfer switch according to claim 9, wherein each MEMS switch is a single pole single throw switching unit.

21. The MEMS transfer switch according to claim 20, wherein the four MEMS switching units are collectively arranged as a double pole double throw switch.

* * * * *